US008834187B2

(12) United States Patent
Furuya et al.

(10) Patent No.: US 8,834,187 B2
(45) Date of Patent: Sep. 16, 2014

(54) LEVER-ENGAGING CONNECTOR AND CONNECTOR UNIT HAVING THE CONNECTOR

(75) Inventors: Yoshinobu Furuya, Makinohara (JP); Hirotaka Hasegawa, Makinohara (JP); Hiroshi Fukuda, Makinohara (JP)

(73) Assignee: Yazaki Corporation, Tokyo (JP)

( * ) Notice: Subject to any disclaimer, the term of this patent is extended or adjusted under 35 U.S.C. 154(b) by 19 days.

(21) Appl. No.: 13/819,484

(22) PCT Filed: Sep. 6, 2011

(86) PCT No.: PCT/JP2011/070234

§ 371 (c)(1),
(2), (4) Date: Feb. 27, 2013

(87) PCT Pub. No.: WO2012/033081

PCT Pub. Date: Mar. 15, 2012

(65) Prior Publication Data

US 2013/0164959 A1 Jun. 27, 2013

(30) Foreign Application Priority Data

Sep. 9, 2010 (JP) ..... 2010-201747

(51) Int. Cl.

| | |
|---|---|
| ***H01R 13/62*** | (2006.01) |
| ***H01R 13/629*** | (2006.01) |
| ***H01R 13/46*** | (2006.01) |
| ***H01R 13/639*** | (2006.01) |

(52) U.S. Cl.

CPC ..... *H01R 13/62933* (2013.01); *H01R 13/465* (2013.01); *H01R 13/6397* (2013.01)

USPC ..... 439/153

(58) Field of Classification Search

USPC ..... 439/157, 153, 160, 152

See application file for complete search history.

(56) References Cited

U.S. PATENT DOCUMENTS 5,253,140 A * 10/1993 Inoue et al. ..... 361/728
5,613,874 A * 3/1997 Orlando et al. ..... 439/491

(Continued)

FOREIGN PATENT DOCUMENTS

| | | | |
|---|---|---|---|
| DE | 10038106 | A1 | 3/2001 |
| GB | 2387042 | A | 10/2003 |
| JP | 10-321289 | A | 12/1998 |

OTHER PUBLICATIONS

International Search Report dated Dec. 6, 2011, issued for PCT/JP2011/070234.

(Continued)

*Primary Examiner* — Alexander Gilman

(74) *Attorney, Agent, or Firm* — Edwards Wildman Palmer LLP

(57) ABSTRACT

A connector for determining whether or not to having been disengaged from the mating connector 2 to be exploded includes a housing including a main body accommodating a terminal fitting, and a pair of projections projecting from the main body; a lever including a pair of plates provided with holes through which each of the pair of projections is passed, and the pair of plates sandwiching the main body therewithin, the lever being arranged rotatively about the pair of projections. The lever includes a label-attached part to which a label is attached, the label-attached part is provided with a plate part coupling the pair of plates to each other, the plate part has a slit open to the hole, extending toward the plate-coupling part, and the label is attached to the label-attached part so as to cover the slit.

4 Claims, 4 Drawing Sheets

(56) References Cited

U.S. PATENT DOCUMENTS

| | | | | |
|---|---|---|---|---|
| 5,735,708 | A * | 4/1998 | Arnett et al. | 439/491 |
| 6,176,713 | B1 * | 1/2001 | Okabe | 439/157 |
| 6,213,794 | B1 * | 4/2001 | Okabe et al. | 439/157 |
| 6,352,440 | B1 * | 3/2002 | Okabe et al. | 439/157 |
| 6,402,534 | B2 * | 6/2002 | Okabe et al. | 439/157 |
| 6,656,037 | B2 * | 12/2003 | Matsushita | 439/544 |
| 6,976,887 | B2 * | 12/2005 | Shigeta et al. | 439/717 |
| 7,445,475 | B2 * | 11/2008 | Tajiri et al. | 439/157 |
| 7,578,685 | B2 * | 8/2009 | Matsumura et al. | 439/157 |
| 7,637,757 | B2 * | 12/2009 | Matsumura et al. | 439/157 |
| 7,976,322 | B2 * | 7/2011 | Matsumura et al. | 439/153 |
| 2002/0173186 | A1 | 11/2002 | Tsuchiya | |
| 2005/0098419 | A1 * | 5/2005 | Matsui et al. | 200/311 |

OTHER PUBLICATIONS

Supplementary European Search Report dated Feb. 18, 2014, issued for the corresponding European patent application No. 11 82 3556.3.

* cited by examiner

LEVER-ENGAGING CONNECTOR AND CONNECTOR UNIT HAVING THE CONNECTOR

TECHNICAL FIELD

This invention relates to a lever-engaging connector, which approaches to, and is engaged with, a mating connector by rotating a lever, and relates to a connector unit having the lever-engaging connector.

BACKGROUND ART

A connector of the above-mentioned conventional lever-engaging connector, as shown in FIGS. 8 and 9, is mounted to an electric vehicle, and is engaged with a mating connector 102 installed in a power source circuit in order to supply power from battery with a load, and includes a housing 104 accommodated in a terminal fitting 104 (not shown), a pair of plates 151 sandwiching the housing 104 therewithin, a plate-coupling part 159 coupling the pair of plates 151 to each other, and a lever 105 adapted to be rotatively attached to the housing 104. The lever 105 rotating from a disengaged position prior to engagement with the mating connector 102 makes the connectors 101 and 102 approach to each other and to be positioned at an engaging position. The electric vehicle to which these connectors 101 and 102 are mounted has a battery with larger volume of power than that for such conventional gasoline-powered engine, and thereby on a surface of the housing 104 a warning label 109 to notify warning is attached.

In the electric vehicle to which the above-mentioned conventional connector is mounted, the lever 105, when an electric system is maintained, is rotated and positioned from the engaging position to disengaged position, and the connector is disengaged from the mating connector 102, then the lever of the connector 101 disengaged from the mating connector 102 is widened so as to separate the pair of plates 151 from each other in a separating direction, and then the connector is removed from the housing 104 to be exploded.

SUMMARY OF INVENTION

Technical Problem

Notwithstanding, the forgoing conventional connector 101 poses drawbacks, i.e., although the conventional connector 101 has a warning label 109 to be attached on surface of the housing 104 for notifying warning to a worker, e.g., the conventional connector 101, upon trouble occurring relevant to an electric system in the electric vehicle, is disengaged from the mating connector 102 by another worker, resulting in difficulty for the worker of the electric vehicle manufacturer determine cause of the trouble because of no idea as to whether or not the conventional connector disengaged from the mating connector 102 is the one that the lever 105 has been disengaged from the housing 104, i.e., has been exploded.

Accordingly, it is an object of the invention to provide a connector visually identifiable whether the connector has been disengaged from the mating connector mounted to the electric vehicle, or the connector has not been disengaged from the mating connector and has not been exploded.

Solution to Problem

In order to attain the above-mentioned object, a first aspect of the present invention provides (a) a housing including a main body accommodating a terminal fitting and a pair of projections projecting from the main body; (b) a lever rotatively arranged about the pair of projections, wherein the lever-engaging connector approaches to, and engages with, a mating connector by rotating the lever, the lever including: (i) a pair of plates provided with holes passing the pair of projections therethrough, the pair of plates adapted to sandwich the main body therewithin; (ii) a plate-coupling part adapted to couple the pair of plates; and (iii) a label-attached part for attaching a label thereto provided with a plate part having a slit extending toward the plate-coupling part and open to the holes, the plate part being adapted to couple the pair of plates to each other, wherein the label is attached to the label-attached part so as to cover the slit.

Preferably, according to a second aspect of the present invention, in the lever-engaging connector of the first aspect, the slit is configured to widen as approaching to the holes, so as to approach to each of the plates.

Preferably, according to a third aspect of the present invention, a connector unit comprises: (a) the lever-engaging connector of the first or the second aspect, including a housing and a lever arranged rotatively about the housing, (b) a mating connector approaching to, and engaging with, the housing by rotating the lever relative to the housing.

Advantageous Effects of Invention

According to the first aspect of the invention, since the lever-engaging connector comprises: (a) a housing including a main body accommodating a terminal fitting, and a pair of projections projecting from the main body; (b) a lever including: (i) a pair of plates provided with holes through which each of the pair of projections is passed, and the pair of plates sandwiching the main body therewithin, (ii) a plate-coupling part coupling the pair of plates, the lever being arranged rotatively about the pair of projections, wherein by rotating the lever, the lever-engaging connector approaching to, and being engaged with, a mating connector, and (iii) a label-attached part for attaching a label thereto provided with a plate part having a slit extending toward the plate-coupling part and open to the holes, the plate part being adapted to couple the pair of plates to each other, wherein the label is attached to the label-attached part so as to cover the slit, it is made possible to provide the lever-engaging connector that if the lever-engaging connector is disengaged from the mating connector by another worker, and the lever is removed from the housing of the connector disengaged from the mating connector, i.e., exploded, the label is torn, and by which the worker of the electric vehicle manufacturer thus visually determines whether the connector has been disengaged from the mating connector to be exploded, or the connector has not been disengaged from the mating connector.

According to the second aspect of the invention, since the slit is configured to widen as approaching to the holes, so as to approach to each of the plates, it is made possible to securely tear the label when the lever being removed from the housing, i.e., being exploded, because the plate is formed to likely bend in such a direction as separating away from each other as approaching to the holes, and the label is thus likely torn as the plate approaching to the holes.

According to the third aspect of the invention, since the connector unit comprises: (a) the lever-engaging connector of the first or the second aspect, including a housing and a lever arranged rotatively about the housing, (b) a mating connector approaching to, and engaging with, the housing by rotating the lever relative to the housing, it is made possible to provide the connector unit that if the lever-engaging connector is disengaged from the mating connector by other worker, and the lever is removed from the housing of the connector disengaged from the mating connector, i.e., is exploded, the label is torn, and by which the worker of the electric vehicle manufacturer thus visually determines whether the connector has been disengaged from the mating connector to be exploded, or the connector has not been disengaged from the mating connector.

DESCRIPTION OF EMBODIMENTS

A power circuit blocking device as a connector unit according to one embodiment of the present invention will be hereinafter discussed with reference to FIGS. 1 to 7. The power circuit blocking device 10 is installed into a power circuit in order to supply power with a load from a battery mounted to an electric vehicle, and is, as necessary, made open or closed to this power circuit.

Figure 1:
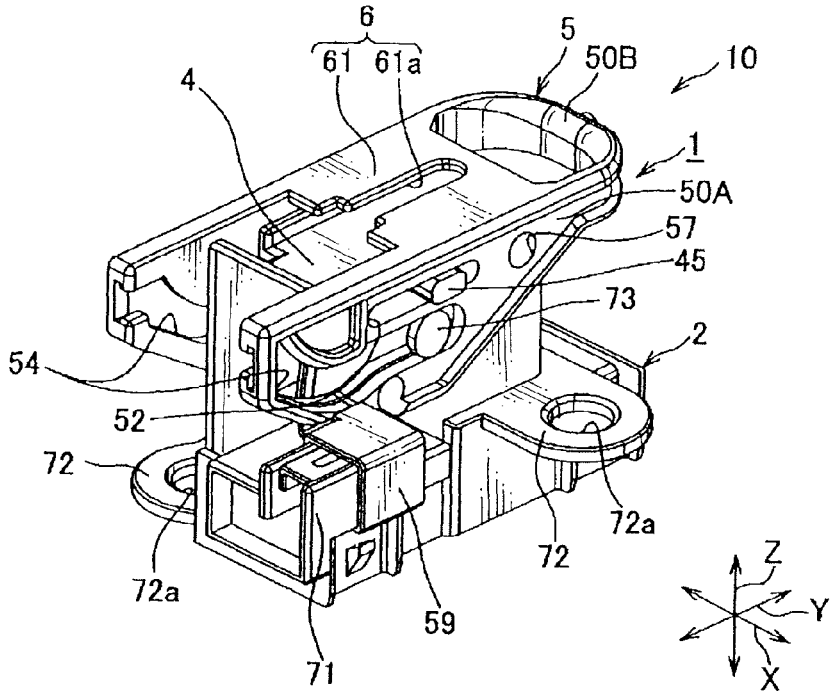
FIG. 1 is a perspective view illustrating a connector unit according to one embodiment of the present invention.
Figure 2:
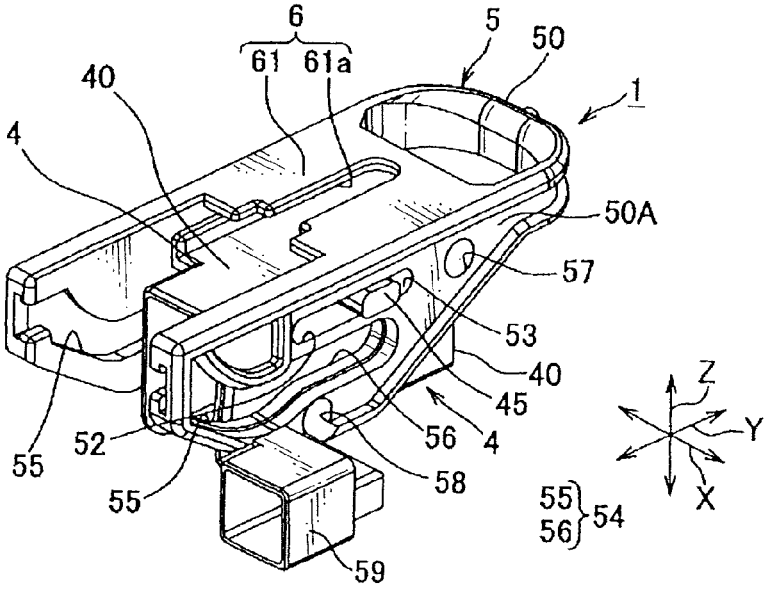
FIG. 2 is a perspective view of a connector composing the connector unit illustrated in FIG. 1.

The forgoing power circuit blocking device 10, as shown in FIGS. 1 and 2, is provide with a connector 1 as a lever-engaging connector including a female terminal as a terminal fitting, a housing 4 formed into box shape accommodating the female terminal, a lever 5 formed into U-shape crossing the housing 4, and arranged rotatively about the housing 4, and a mating connector 2 adapted to approach to and be engaged with the housing 4 or connector 1 by the lever 5 being rotated.

Herein, called "not-engaging position" is a position where the lever 5 is positioned before rotation relative to the housing 4, or before the connector 1 is engaged with the connector 1, whereas, "engaging position" a position where the connector 1 is engaged with the mating connector 2, or the lever 5 is rotated relative to the housing 4 to be positioned, "engaging-finished position" a position where after positioned at the engaging position, the lever 5 is slid relative to the housing 4.

In a state in which the connector 1 is engaged with the mating connector 2, i.e., the lever 5 is positioned at the engaging position, and the power circuit remains open, i.e., blocked, whereas in a state in which the connector 1 is also engaged with the mating connector 2, i.e., the lever 5 is positioned at the engaging position, the lever 5 is slid relative to the housing 4 to be positioned at the engaging-finished position, thereby the power circuit being made closed.

An arrow Z direction shown in such FIG. 1 indicates an engaging direction in which the connector 1 and the mating connector 2 approach to each other, an arrow X direction an projecting direction in which a pair of rotation axis 45 as described later disposed in the housing 4 projects, an arrow Y direction an intersecting direction in which the arrow X direction (that is, the projecting direction) and the arrow Z direction (that is, the engaging direction) intersect to each other, and in which the lever 5 is slid relative to the housing 4 after positioned at the engaging positioned.

The aforementioned housing 4, as shown in FIG. 2, is provided with a tube-shaped main body 40 with bottom, a rotation axis 45 as a pair of projections projecting in a direction separating from the main body 40 to each other, i.e., the arrow X direction, through which holes 52 as described later are passed, a locking part (not shown) disposed at a position arranged along each of the rotation axes 45 in a sliding direction (that is, the arrow Y direction). These main body 40, the pair of rotation axes 45, and the locking part are made of insulating resin and formed integrally by known injection molding.

Figure 3:
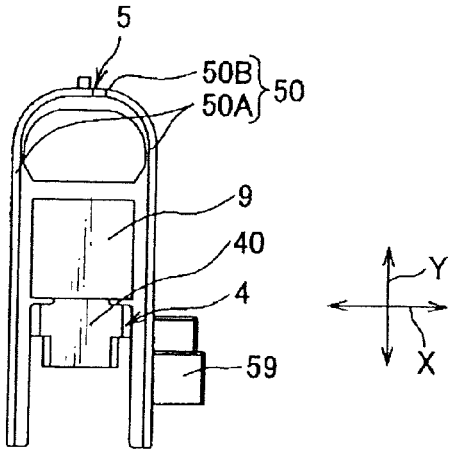
FIG. 3 is a top view of the connector illustrated in FIG. 1.
Figure 4:
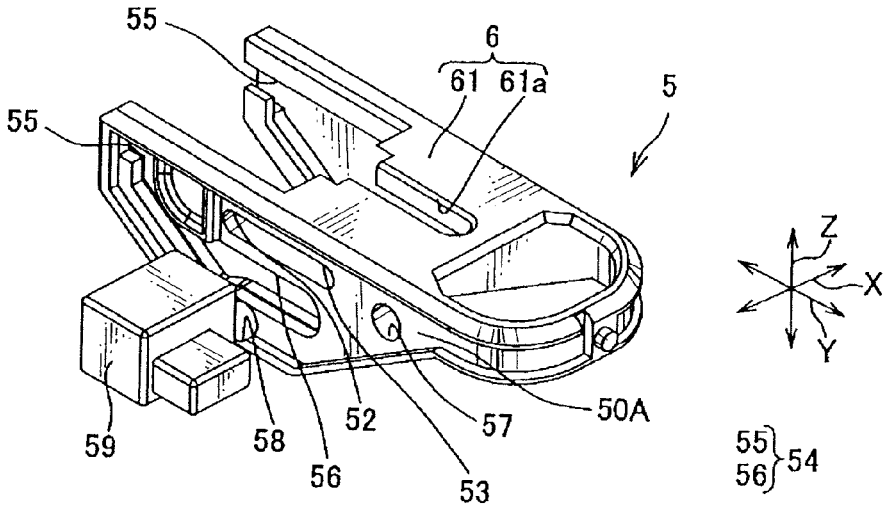
FIG. 4 is a perspective view illustrating a lever illustrated in FIG. 1.
Figure 5:
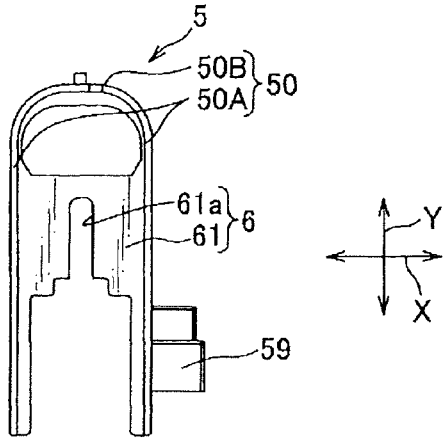
FIG. 5 is a top view illustrating the lever illustrated in FIG. 3.

The aforementioned lever 5, as shown in FIGS. 3, 4 and 5, is provided with a lever main body 50 formed in U-shape by a pair of plates 50A disposed so as to sandwich therewithin the main body 40 disposed in the housing 40, a plate coupling part 50B coupling the pair of plates 50*a* to each other, a label-attached part 6 disposed in the lever main body 50 to which a warning label 9 as a label is attached, an outside tube 59 disposed in an outside direction of one of the pair of plates 50A, and a first conductive sensor terminal (not shown) attached to inside the outside tube 59. These lever main body 50, the label-attached part 6, and the outside tube 59 are made of insulating resin and formed integrally by known injection molding.

The aforementioned the pair of plates 50A is formed flexible in a direction of approaching to, or separating from, each other (that is, the arrow X direction). Each of the plates 50A is provided with a hole 52 through which the aforementioned rotation axes 45 disposed in the housing 4 pass, a guide groove 53 formed straight, communicating with the hole 52, and in the sliding direction (that is, the arrow Y direction) from the hole groove 53, a cam groove 54 through which a cam pin 73 disposed in the mating connector 2 as described later is passed, a first lock-receiving part 57 into which a locking part disposed in the main body 40 enters upon the lever 5 being positioned at the not-engaging position, a second lock-receiving part 58 into which a locking part disposed in the main body 40 enters upon the lever 5 being positioned at the engaging position.

The aforementioned cam groove 54 is provided with an arc part 55 formed so as to run in a circumference direction about the hole 52 and passing through the plate part 50A, and a second guide groove 56 formed straight so as to run along the guide groove 53. The aforementioned arc part 55 is disposed so as to open to an end, or an outside edge separating from the plate coupling part 50B of the plate 50A, while into an opening of the cam groove 54 (that is, the arc part 55) opening to the outside edge, the cam pin 73 as described later of the mating connector 2 enters with the lever 5 at the not-engaging position.

Figure 6:
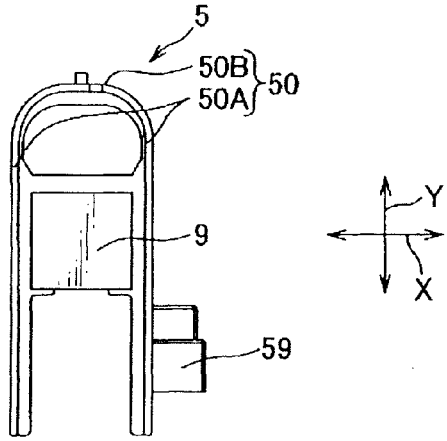
FIG. 6 is a top view of a state that a label is attached to the lever illustrated in FIG. 5.
Figure 7:
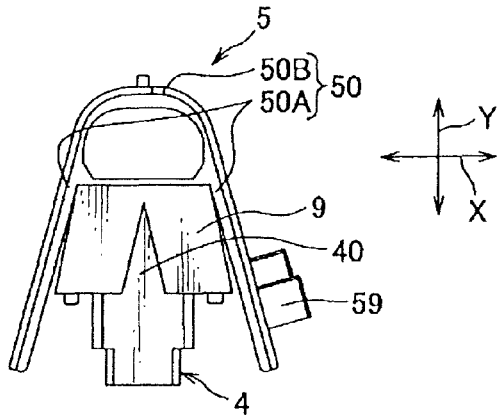
FIG. 7 is a top view of a state that the lever composing the connector illustrated in FIG. 1 is removed from a housing.
Figure 8:
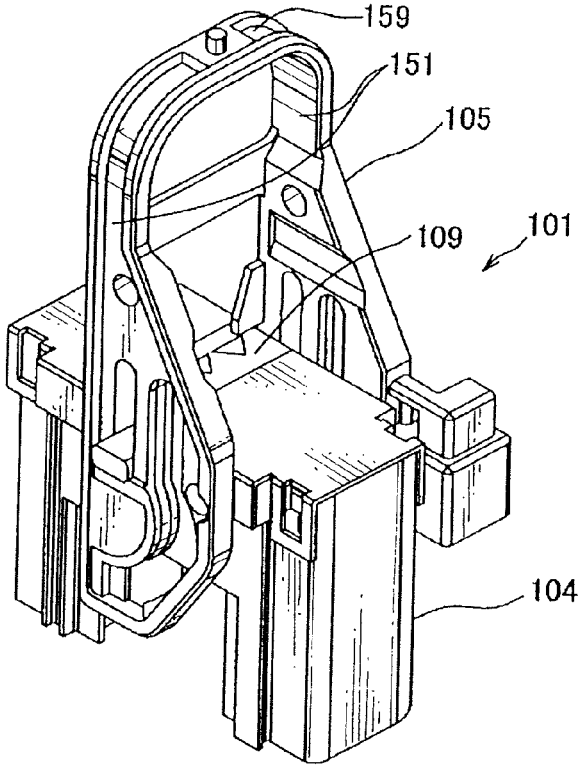
FIG. 8 is a perspective view illustrating a conventional connector.
Figure 9:
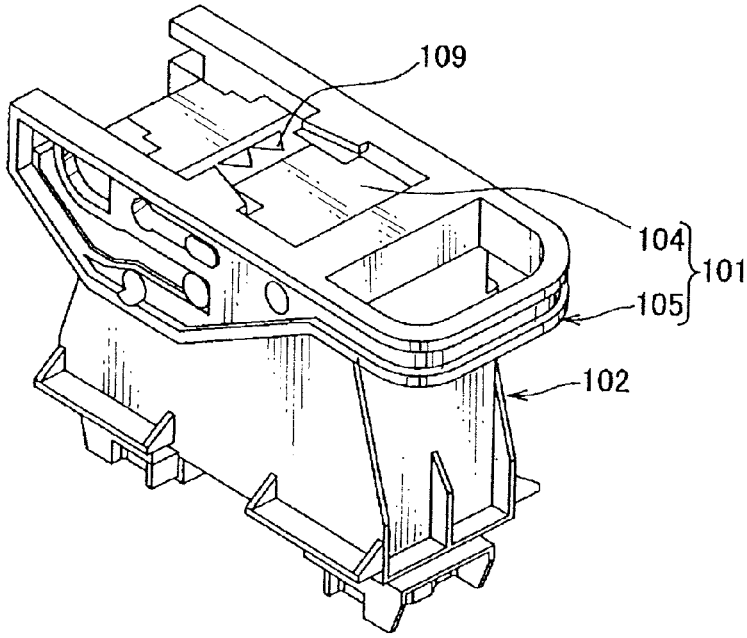
FIG. 9 is a perspective view of a state that the connector illustrated in FIG. 8 is engaged with a mating connector.

On the aforementioned label-attached part 6 a plate 61 as shown in FIGS. 5 and 6 is disposed to couple the pair of plates 50A to each other, and in the plate part 61*a* slit is disposed open to the hole 52 side (that is, a side separating from the plate coupling part 503 in the arrow Y direction), extending toward the plate coupling part 50B. The slit 61*a* is formed to widen as approaching to the hole 52 so as to approach to each of the plates 50A, i.e., the plate part 61 approaches to each of the plates 50A as running toward the hole 52. The warning label 9 to be attached to the label-attached part 6 is attached so as to cover the slit 61*a*.

The aforementioned outside tube 59 is formed tubular, inside which a first conductive sensor terminal is attached to. Into the outside tube 59 an inside tube 71 as described later disposed in the mating connector 2 is inserted.

The mating connector 2, as shown in FIG. 1, is provided with a pair of male terminals to be connected with female terminals, disposed separated from each other, a second housing 7 accommodating the pair of male terminals and formed into box shape, and a pair of second sensor terminals (not shown) to be connected with the first terminal disposed in the aforementioned lever 5.

The aforementioned second housing 7 is provided with a second main body 70 accommodating main body 40 disposed in the aforementioned connector 1, a cam pin 73 projecting in a direction separating from the second main body 70 to each other (the arrow X direction), an inside tube 71 provided so as to project from the second main body 70 and accommodated inside the outside tube 59 disposed in the aforementioned lever 53, a plurality of car body-attaching parts 72 (e.g., two parts in an illustrated example) disposed so as to project from the main body 70, including holes 72*a* stacked on a car body panel composing the car body in order to attach the mating connector 2 to the car body of the vehicle.

The aforementioned inside tube 71 is formed tubular having an opening open in the sliding direction (the arrow Y direction), and a pair of second sensor inside.

The aforementioned the pair of second sensor terminals disposed at some interval (that is, separated from each other). One of the pair of second sensors is connected with the battery, the other the load. The pair of second sensor terminals are, when the lever 5 is positioned at the engaging-finished position, made connected with each other by the first sensor terminal, so that these first sensor and each of the second sensors are electrically connected, resulting in the power circuit being closed (formed into closed circuit).

A method of assembling the aforementioned power circuit blocking device 10 will be discussed. First, preliminarily, one of the male terminal of the pair of male terminals is connected with the battery, the other the load via electric wire, and car body-engaging part 72 of the mating connector 2 and the car body panel are stacked, passing bolt into the hole 72 of the car body engaging part 72, threading into screw nut disposed in the car body panel, and thereby the mating connector 2 is attached to the car body (that is, car body panel).

Then, after female terminal is attached to the main body 40 (the housing 4), the pair of plates 50A of the lever 5 is widened so as to separate from each other to pass each of the rotation axes 45 through each of the holes 52 of the lever 5 so as to sandwich the main body 40 therebetween. The locking part disposed in the housing 4 thus enters into the first lock receiving part 57 disposed in the lever 5. The lever 5 at the same time is positioned at the not-engaging position that is located before its rotation relative to the housing 4. Furthermore, the label 9 is attached such that the slit 61*a* of the label-attached part 6 is covered. Thus, the connector 1 is completed.

Subsequently, the main body 40 (the connector 1) is approached to the second main body 50 (the mating connector 2) in such a way that the connector 1, while the lever 5 is positioned at not-engaging position relative to the housing 4, passes the cam pin 73 through the opening of the cam groove 54. The lever 5, while the connectors 1 and mating connector 2 approaching to each other, is rotated relative to the housing 4. The cam pin 73 is then moved (or is slid) along an inner edge of the arc part 55 inside of the arc part 55 of the cam groove 54. Thus, the main body 40 is accommodated in the second main body 50, and the pair of male terminals enters into inside the female terminal, and then is each connected with the female terminals, and the lever 5 is thus positioned at the engaging position to engage these connectors 1 and 2 to each other.

When the lever 5 is positioned at the engaging position, the pair of second sensor terminals is separated from each other, and thus the power circuit lies open, and current from the male terminal to the female terminal is not carried.

Furthermore, the lever 5 is positioned at the engaging position, and the lever 5 is slid relative to the housings 4 and 7. Then the cam pin 73 is moved inside the guide groove 56 along the inner edge of the second cam groove 56, and the rotation axis 45 is moved (or is slid) inside the guide groove 53 along the inner edge of the guide groove 53. Then, the lock part disposed in the housing 4 enters into the second lock receiving part 58, and into the outer tube 59 disposed in the lever 5, and the inner tube 71 disposed in the second housing 7 is inserted, and then the first pair of sensor terminals is connected with the second pair of sensor terminals, the lever 5 is at the same time positioned at the engaging-finished position. Thus, the lever being positioned at the engaging-finished position electrically connects the second sensor terminals to each other by the first pair of sensor terminals, and thus closing the power circuit, resulting in current from the male terminal to the female terminal being carried.

Then, procedure for disengaging the connector 1 positioned at the engaging-finished position from the mating connector 2 using the lever 5 will be discussed. First, the lever 5, while positioned at the engaging-finished position, is slid in the sliding direction (the arrow Y direction) relative to the housings 4 and 7. The rotation axis is thus moved (that is, is slid) along the guide groove 53 disposed in the lever 5, the cam pin 73 is at the same time moved (is slid) along the second guide groove 56, the inner tube 71 is pulled out from the outer tube 59 accommodating the inner tube 71, and the outer tube 59 disposed in the lever 5 and the inner tube 71 disposed in the second housing 7 are separated from each other, so that the first sensor terminal and the second sensor terminal are separated from each other. The lever 5 is thus positioned at the engaging position. The pair of second sensor terminals at this time lies separated from each other, and thus power circuit comes into open; current from the male terminal to the female terminal is terminated.

Furthermore, the lever 5, while positioned at the engaging position, is rotated to be positioned at the not-engaging position. The main body 40 being thus pulled out from the second main body 70 accommodating the main body 40 makes the female terminal and the pair of male terminal to be separated from each other. The lever 5 is thus positioned at the not-engaging position; the connector 1 is at the same time disengaged from the mating connector 2.

Then, procedure for disengaging (or exploding) the lever 5 from the housing 4 of the connector 1 that is disengaged from the mating connector 2 will be discussed. The connector 1 disengaged from the mating connector 2, while positioned at the not-engaging position, widens the pair of plates 50A in a direction separating from each other (the arrow X direction). The pair of plates 50A is thus elastically deformed in the direction separating from each other (the arrow X direction), the warning label 9 attached to the label-attached part 6 is gradually torn from opening side of the slit 61*a* (the hole 52 side). Thus, the warning label 9 attached to the label-attached part 6 is torn in a direction of the slit 61*a* extending from the opening side of the slit 61*a*. After the warning label 9 attached so as to cover the slit 61*a* is torn, the rotation axes 45 disposed in the housing 4 are disengaged from the holes 52 disposed in the lever 52, so that the lever 5 is disengaged from the lever 5. Thus, the connector 1 is exploded.

According to the aforementioned connector 1 as a lever-engaging connector and the power circuit block device 10 as the connector unit including the connector 1, the connector 1 comprises the housing 4 including the main body 40 accommodating the female terminal as terminal, the rotation axis 45 as the pair of projections projecting from the main body 40; the lever 5 including the pair of plates 50A having the holes 52 the pair of projections passes through, and sandwiching the main body 40 therebetween, and the plate coupling 50B coupling the pair of plates 50A to each other, the lever 5 rotatively disposed about the rotation axis 45, its rotation allowing the connector 1 approach to, and engage with, the mating connector 2, wherein the lever 5 includes the label-attached part for attaching the warning label as the label, the label-attached part 6 includes the plate part 61 coupling the pair of plates 50A to each other, the plate part 61 includes the slit 61*a* open to the hole 52 side, formed in the direction (the arrow Y direction) crossing both the projecting direction (the arrow X direction) and the engaging direction (the arrow Z direction), the warning label 9 is attached so as to cover the slit 61*a*, it is made possible to provide the lever-engaging connector that if the lever-engaging connector is disengaged from the mating connector by worker other than that of the manufacture, and the lever is removed from the housing of the connector disengaged from the mating connector, i.e., is exploded, the warning label is torn, by which the worker of the electric vehicle manufacturer thus visually determines the connector 1 has been disengaged from the mating connector 2, to be exploded, and that thus can be determined whether or not the connector 1 has been disengaged from the mating connector 2 to be exploded.

Since the slit 61*a* is configured to widen as approaching to the holes 52, so as to approach to each of the plates 50A, and the plates 50A are configured to be easily bent in the direction of the pair of plates 50A away from each other (the arrow X direction) as approaching to the hole 52, and the warning label 9 is thus easily torn as the plate part 61 approaches to the hole 52, it is made possible to securely tear the warning label 9 when the lever 5 is removed from the housing 4, i.e., being exploded.

Since the electric circuit block device as the connector unit comprises the lever-engaging connector 1 including the housing 4, and the lever 4 arranged ratatively about the housing 4; a mating connector 2, by the lever 5 being rotated relative to the housing 4, approaching to, and being engaged with, the housing 4, wherein the connector 1 is the lever-engaging connector 1 of the first or second aspect, it is made possible to provide the connector unit that if the lever-engaging connector 1 is disengaged from the mating connector 2 by worker other than that of the electric vehicle manufacturer, and the lever 5 is removed from the housing 4 of the connector 1 disengaged from the mating connector 2, i.e., is exploded, the label is torn, i.e., the warning label 9 is torn, by which the worker of the electric vehicle manufacturer thus visually determines the connector 1 has been disengaged from the mating connector 2 to be exploded, and that thus can be determined whether or not the connector 1 has been disengaged from the mating connector 2 to be exploded.

It is to be understood the aforementioned embodiment only shows a typical one of the present invention but the present invention is not limited to the examples discussed above. Therefore, unless otherwise such changes and modifications depart from the scope of the present invention hereinafter defined, they should be construed as being included therein.

REFERENCE SIGNS LIST

10 power circuit block device (connector unit)
1 connector (lever-engaging connector)
2 mating connector
40 main body
45 rotation axis (projection)
5 lever
50A plate part
50B plate coupling part
52 hole
6 label-attached part
61 plate part
61*a* slit

The invention claimed is:

1. A lever-engaging connector comprising:

(a) a housing including a main body accommodating a terminal fitting and a pair of projections projecting from the main body;

(b) a lever rotatively arranged about the pair of projections, wherein the lever-engaging connector approaches to, and engages with, a mating connector by rotating the lever, the lever including:

(i) a pair of plates provided with holes passing the pair of projections therethrough, the pair of plates adapted to sandwich the main body therewithin;

(ii) a plate-coupling part adapted to couple the pair of plates; and (iii) a label-attached part for attaching a label thereto provided with a plate part having a slit extending toward the plate-coupling part and open to the holes, the plate part being adapted to couple the pair of plates to each other, wherein the label is attached to the label-attached part so as to cover the slit.

2. The lever-engaging connector as claimed in claim 1, wherein the slit is configured to widen as approaching to the holes, so as to approach to each of the pair of plates.

3. A connector unit comprising:

(a) the lever-engaging connector as claimed in claim 1, including a housing and a lever arranged rotatively about the housing, (b) a mating connector approaching to, and engaging with, the housing by rotating the lever relative to the housing.

4. A connector unit comprising:

(a) the lever-engaging connector as claimed in claim 2, including a housing and a lever arranged rotatively about the housing, (b) a mating connector approaching to, and engaging with, the housing by rotating the lever relative to the housing.

* * * * *